US006698222B2

(12) United States Patent
Sanna et al.

(10) Patent No.: US 6,698,222 B2
(45) Date of Patent: Mar. 2, 2004

(54) REMOVABLE FOOD SUPPORT ELEMENT IN A REFRIGERATOR WITH MEANS FOR SETTING THE TEMPERATURE OF THE COMPARTMENT IN WHICH IT IS POSITIONED, AND A REFRIGERATOR CONTAINING SUCH A COMPARTMENT

(75) Inventors: Salvatore Sanna, Biandronno (IT); Davide Braggion, Besozzo (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/216,606

(22) Filed: Aug. 9, 2002

(65) Prior Publication Data

US 2003/0033824 A1 Feb. 20, 2003

(30) Foreign Application Priority Data

Aug. 14, 2001 (IT) ..... MI2001A1798

(51) Int. Cl.[7] ..... F25B 1/00; F25D 23/12
(52) U.S. Cl. ..... 62/229; 62/259.1
(58) Field of Search ..... 62/229, 259.1, 62/263, 448; 236/51

(56) References Cited

U.S. PATENT DOCUMENTS

| | | | | |
|---|---|---|---|---|
| 2,997,356 A | | 8/1961 | Hilliker et al. | 312/348 |
| 4,148,194 A | | 4/1979 | Kells | 62/3 |
| 4,936,106 A | | 6/1990 | Beach et al. | 62/131 |
| 6,166,353 A | * | 12/2000 | Senneville et al. | 219/385 |
| 6,584,786 B2 | * | 7/2003 | Tavolazzi | 62/125 |
| 2002/0184906 A1 | * | 12/2002 | Faries, Jr. | 62/229 |
| 2003/0122455 A1 | * | 7/2003 | Caldwell | 312/6 |
| 2003/0131620 A1 | * | 7/2003 | Sanna | 62/229 |

FOREIGN PATENT DOCUMENTS

| | | | | |
|---|---|---|---|---|
| DE | 3604759 A1 | * | 8/1987 | F25D/23/00 |
| DE | 19505830 | | 8/1995 | F25D/29/00 |
| DE | 9417655 | | 2/1996 | F25D/29/00 |

* cited by examiner

*Primary Examiner*—Marc Norman
(74) *Attorney, Agent, or Firm*—Robert O. Rice; John F. Colligan; Stephen Krefman

(57) ABSTRACT

A removable food support element in a refrigerator, for example a shelf, drawer or the like, comprising a body to be positioned on supports present on opposing walls of a refrigerator compartment; there being provided, associated with the body of the element, setting means enabling the internal temperature of the refrigerator compartment to be set and the set temperature information to be transferred to control means for the refrigerator refrigeration circuit.
The refrigerator provided with such a compartment is also claimed.

9 Claims, 3 Drawing Sheets

REMOVABLE FOOD SUPPORT ELEMENT IN A REFRIGERATOR WITH MEANS FOR SETTING THE TEMPERATURE OF THE COMPARTMENT IN WHICH IT IS POSITIONED, AND A REFRIGERATOR CONTAINING SUCH A COMPARTMENT

BACKGROUND OF THE INVENTION

1. Field of the Invention

The present invention relates to a food support element in a refrigerator, in accordance with the introduction to the main claim. The term "refrigerator" used herein means both refrigerated cabinets in which the temperature is normally higher than 0° C., and freezers in which the temperature is maintained below 0° C.

In a refrigerator (static or forced-air) it is very important to correctly determine the temperature of each of its preservation or freezer compartments in order to obtain optimum preservation of the foods contained therein.

2. Description of the Related Art

Various devices are known for enabling said determination, these devices generally measuring said temperature in correspondence with a wall of said compartment or in correspondence with a conduit through which air is fed into the compartment (in the case of a forced-air refrigerator), or indirectly by measuring the evaporator temperature. Although enabling functional monitoring of the temperature in the refrigerator compartment, these devices do not enable the actual temperature within the compartment to be measured or to be maintained at the desired optimum value within the compartment on the basis of the foods present therein. In this respect, this temperature is set by the user by operating an appropriate control associated with a structural part of the refrigerator (compartment wall or door, for example), this setting being maintained by measuring the obtained temperature using the aforesaid known devices, this measurement never however being taken directly at a point in the interior of said compartment, i.e. between its walls where the foods are present, with obvious drawbacks (for example measurement inaccuracies or the need for complex systems for processing the temperature information obtained for example in proximity to a wall in order to define the temperature present within the compartment).

SUMMARY OF THE INVENTION

An object of the present invention is therefore to provide a removable refrigerator element of the aforesaid type which enables a temperature to be set, or enables a class of foods to be set to which a determined temperature range corresponds, and which is to be obtained and possibly maintained within the refrigerator compartment or within a particular region thereof.

Another object is to provide an element which is reliable and easy to use.

A further object is to provide an element which, in a refrigerator or in a forced-air freezer, enables a particular temperature to be maintained within that particular region of the refrigerator compartment in which the element is positioned, on the basis of the type of food positioned on the element.

These and further objects which will be apparent to the expert of the art are attained by an element in accordance with the accompanying claims.

BRIEF DESCRIPTION OF THE DRAWINGS

The present invention will be more apparent from the accompanying drawing, which is provided by way of non-limiting example and in which.

DESCRIPTION OF THE PREFERRED EMBODIMENT

Figure 1:
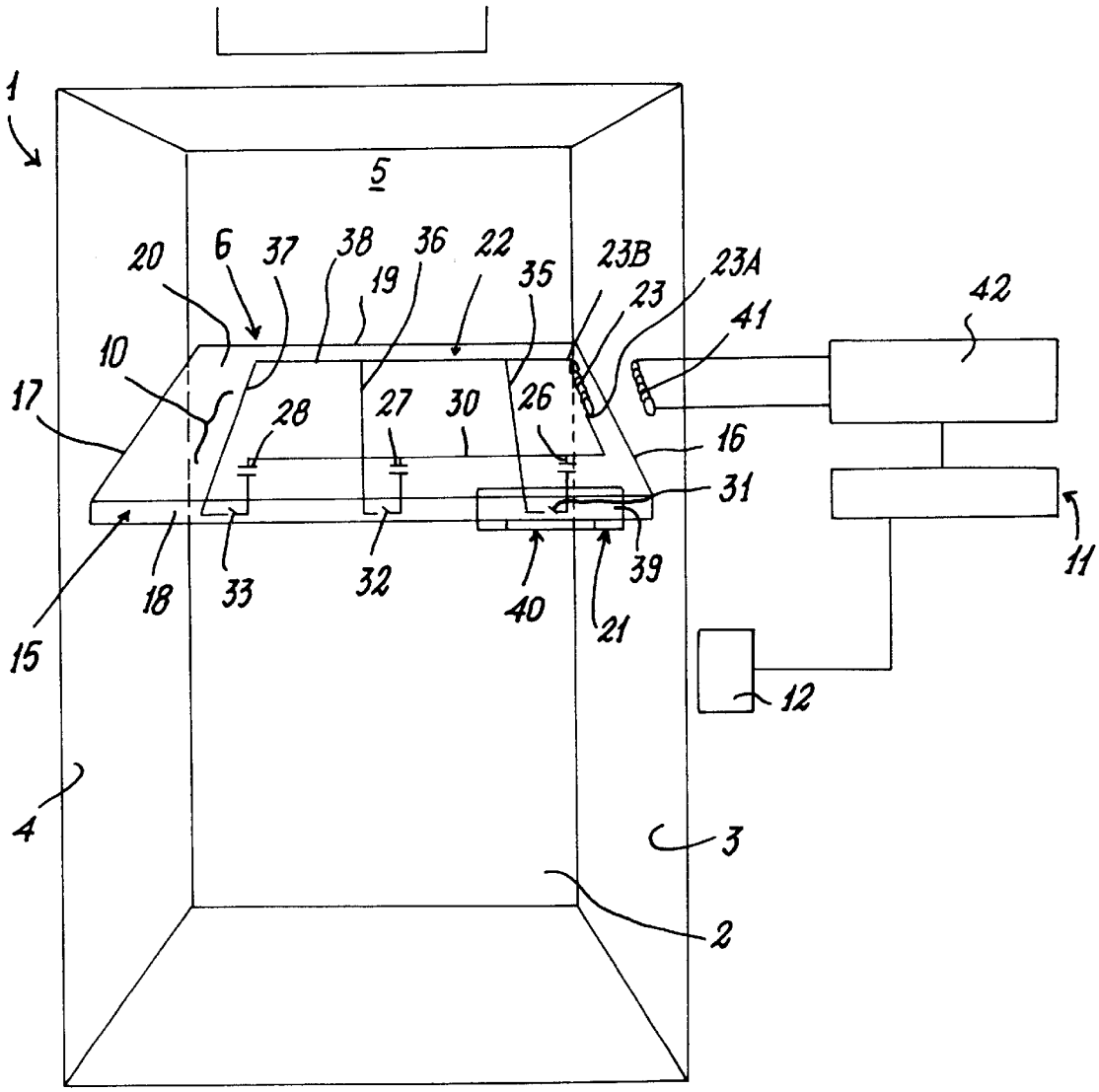
FIG. 1 shows schematically one embodiment of a shelf according to the invention inserted into a refrigerator compartment.

With reference to said figures, a refrigerator is shown schematically in FIG. 1, where it is indicated by 1. The refrigerator can be of the known static or forced-air type.

In the example. the refrigerator is an upright refrigerator and comprises an internal compartment 2 having opposing lateral walls 3, 4 and an end wall or shoulder 5. Usual supports (not shown) are present on the lateral walls to support a shelf 6 formed in accordance with the invention.

The shelf 6 comprises means 10 to enable the internal temperature of the compartment 2 to be set (or a temperature range corresponding to a determined food category to be set) and possibly to be maintained. These means 10 cooperate with the control means 11 controlling the operation of the refrigerator 1, in order. to control and regulate, on the basis of the temperature setting obtained by the setting means, the operation of a usual refrigeration circuit schematically shown in FIG. 1 and indicated by 12.

More specifically, the shelf 6 comprises a body 15 presenting lateral faces 16 and 17 to face the walls 3 and 4 of the compartment 2, a front face 18 and a rear face 19. The shelf 6 presents a flat surface 20 for supporting foods. According to the invention, the body 15 contains the setting means 10 associated with operating means 21 positioned preferably on the aforesaid front face 18. These means for setting the internal temperature of the compartment 2 are an electrical and/or electronic circuit 22 suitably inserted into the body 15, and can be of active type (i.e. self powered for example by batteries) or of passive type.

In the figures the circuit 22 is an electrical circuit of passive type defined by an RLC resonant circuit and comprising an inductor 23 positioned in correspondence with the lateral face 16 of the body 15 of the shelf 6 and a plurality of capacitors (for example three, as in the figures where they are indicated by 26, 27 and 28) of various capacitances. Each capacitor is connected on one side to an electrical line 30 connected to one end of the inductor 23, and on the other side to a change-over switch (31, 32 and 33 respectively) arranged to connect each capacitor to a second electrical line 35, 36 and 37 respectively, connected to an electrical branch 38 connected to the other end of the inductor 23.

Using the operating means 21, a different change-over switch can be activated to connect the corresponding capacitor to the inductor in such a manner as to modify the resonance frequency of the circuit 22.

Figure 2:
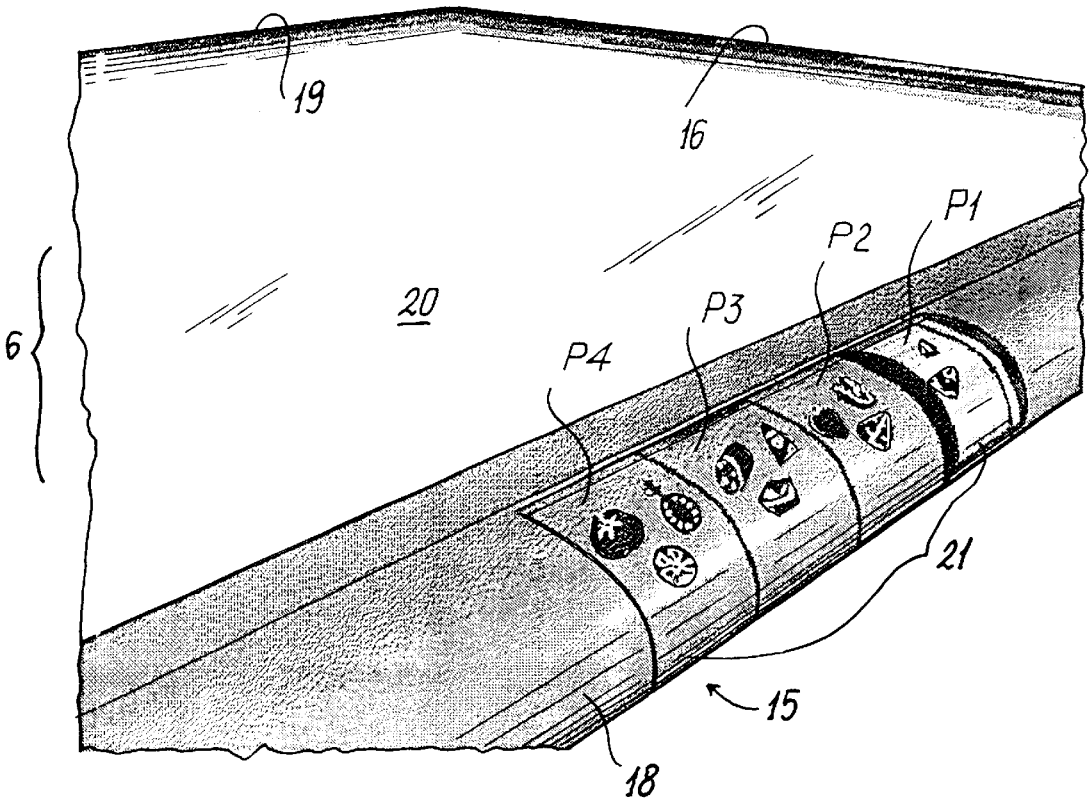
FIG. 2 is a perspective front view of the shelf of FIG. 1.

The operating means 21 can be defined by a plurality of pushbuttons P1, P2, P3 and P4 (FIG. 2) connected to the various capacitors and which, when pressed, result in the selection of a temperature suitable for preserving different foods. For this purpose, each pushbutton carries a symbol corresponding to a particular food. Alternatively, the operating means 21 can be defined by a slidable selector 39 movable along the face 18 of the body 15 of the shelf 6, or by a slidable reed relay, in which case the selector 39 carries a magnet 40 which on sliding in front of the change-over switch defined by a relay, closes it onto the corresponding electrical line. This results in the selection of a particular capacitance for the circuit 22 and hence the selection of a particular resonance frequency. Hence a respective desired temperature within the compartment 2 can be made to correspond to each frequency variation of the circuit 22, this temperature being selected for example via the selector 39.

To enable the circuit 21 to operate, an inductor 41 is positioned in that wall 3 of the compartment 2 which faces the face 16 of the shelf body 15, and is connected to an oscillating circuit 42 connected to the refrigerator control means 11, for example a microprocessor circuit. On powering the oscillating circuit 42, of which the inductor 41 forms part, the circuit 21 is activated, so that each variation in the resonance frequency of said circuit 21 (obtained in the aforesaid manner) is noted as a variation in the resonance of the circuit 42; this is then determined by the control circuit or means 11 which, on the basis of the variation, act on the refrigeration circuit 12.

Figure 3:
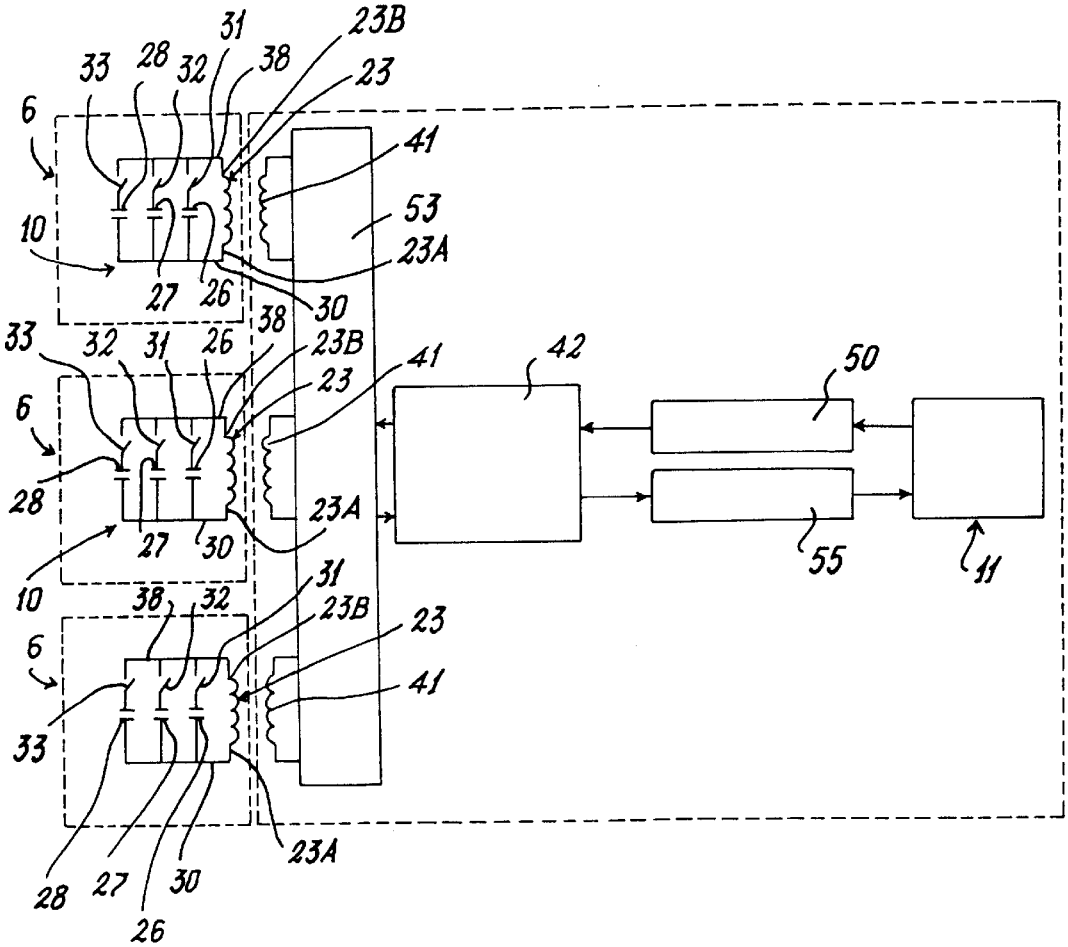
FIG. 3 is a schematic diagram of an electrical/electronic circuit enabling the temperature to be set within the interior of the compartment of FIG. 1 in which several shelves according to the invention are present.

Specific reference will now be made to FIG. 3 showing a plurality of shelves 6 cooperating with an electrical/electronic circuit which determines their resonance frequency variation and on the basis thereof acts on the refrigeration circuit 12. If the embodiment of FIG. 3 is used in a forced-air refrigerator, a particular temperature on each shelf of the refrigerator compartment 2 can be obtained by adjusting in known manner the usual members for modifying the feed of refrigerated air into the various regions of the compartment 2. In this case the shelves 6 are constructed of thermally insulating material.

The use of the invention will now be described with reference to FIG. 3.

It will be assumed that the uppermost shelf 6 of FIG. 3 is to be used. The other shelves will be assumed not to be in use or, if present in the compartment 2, not to be used for setting a local temperature within the refrigerator compartment 2.

As shown in FIG. 3, the control circuit 11 (for example a microprocessor) is connected to the control voltage generator or sweep generator 50, connected to the oscillator 42 which operates with controlled voltage. This latter is connected to a switching element 53 which selects the appropriate inductor 41 for interrogating a determined shelf.

On powering the circuit 42, of which the inductor 41 forms part, and varying the capacitance of the resonant circuit 21, the resonance frequency of the oscillator undergoes, as stated, a variation which is determined by a usual signal sensor 55 (for example a dip catcher), and is therefore determined by the circuit 11. On the basis of this determination, corresponding to the selection of a particular temperature within the compartment 2, the circuit 21 acts on the refrigeration circuit 12 to obtain the desired temperature within the compartment 2 (in correspondence with the shelf 6).

If several shelves 6 are present and "active" within the refrigerator, for example a forced-air refrigerator, any signal variations of the corresponding inductor 41 are discriminated by the control circuit 11 which, by directly operating the switching element, is always able to recognize which inductor has been the origin of the signal generated by the oscillator 42. On the basis of this determination, the circuit 11 can vary the temperature of that portion of the compartment 2 comprising the shelf 6 in question.

In a further embodiment of the invention, any deviation in the actual temperature from that set for each shelf 6 of the invention can be determined directly by the circuit 11, as this temperature variation results in a proportional variation in the capacitance of the capacitor selected by the circuit 21 and hence a variation in the resonance frequency of said circuit (determined by the control circuit 11). This circuit acts on the refrigeration circuit 12 on the basis of this determination.

Two embodiments of the invention have been described. Others can however be devised in the light of the present invention. For example, as stated, the circuit 22 can be of active type and comprise remote connection means (for example of radio-frequency, or other type) able to dialogue with the control means 11 in order to "inform" these latter of the temperature selected by the user for the shelf 6. Alternatively, the circuit 22 can be of the described type, but self-powered and cooperating with a device (passive, of inductor type) connected to the means 11 and not comprising the oscillator 42, the generator 50 or the sensor 55. Moreover, although the described examples refer to a shelf, the circuit 22 can also be provided on a food containing drawer (for example, as in the case of upright freezers).

We claim:

1. A removable food support element in a refrigerator, for example a shelf or drawer, comprising a body to be positioned on supports present on opposing walls of a refrigerator compartment, and, associated with the body of the element, setting means enabling an internal temperature of the refrigerator compartment to be set and the set temperature information to be transferred to a control means for a refrigerator refrigeration circuit, the setting means comprising a resonant circuit arranged to generate a signal which can be modified on the basis of the set temperature, or of a set temperature range, by modifying at least one electrical characteristic of the circuit, the resonant circuit comprising a plurality of capacitors of different capacitances selectively connectable to an inductor cooperating with an induction element associated with the control means and fixed to the refrigerator.

2. An element as claimed in claim 1, wherein the resonant circuit is of passive type, the induction element being connected to an oscillating circuit connected to the control means, and receiving an electrical signal from said circuit.

3. An element as claimed in claim 1, wherein the resonance circuit is self-powered.

4. An element as claimed in claim 1, comprising operating means operationally cooperating with the resonant circuit to select a capacitor of capacitance chosen on the basis of the desired temperature or of the desired temperature range in correspondence with the element.

5. An element as claimed in claim 4, wherein the operating means are a selector movable on a face, preferably the front face, of the element.

6. An element as claimed in claim 4, wherein the operating means are a plurality of pushbuttons operationally connected to the various capacitors.

7. An element as claimed in claim 4, wherein the operating means act on switches arranged to connect different capacitors to the inductor.

8. An element as claimed in claim 1, wherein the electrical circuit comprises radio-frequency signal generating means cooperating with receiving counter-means connected to the control means.

9. A removable food support element in a refrigerator, for example a shelf or drawer, comprising a body to be positioned on supports present on opposing walls of a refrigerator compartment, and, associated with the body of the element, means for measuring the temperature present in the refrigerator compartment, setting means comprising a resonant circuit and configured to enable an internal temperature of the refrigerator compartment to be set and the set temperature information to be transferred to a control means for a refrigerator circuit, the measurement means comprising capacitors of the resonant circuit.

* * * * *